US005956851A

United States Patent [19]

Apprille, Jr. et al.

[11] Patent Number: 5,956,851

[45] **Date of Patent: *Sep. 28, 1999**

[54] SHAVING SYSTEM INCLUDING HANDLE AND REPLACEABLE CARTRIDGES

[75] Inventors: Domenic V. Apprille, Jr., Arlington; William C. Carson, III, Acton; Alejandro C. Lee, Cambridge; Stephen C. Metcalf, West Newton; Charles B. Worrick, Hanson, all of Mass.

[73] Assignee: The Gillette Company, Boston, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/802,381

[22] Filed: Feb. 19, 1997

Related U.S. Application Data

[63] Continuation-in-part of application No. 08/630,437, Apr. 10, 1996, Pat. No. 5,787,586.

[51] Int. Cl.[6] ..... B26B 21/14; B26B 21/52

[52] U.S. Cl. ..... 30/47; 30/50; 30/526; 30/527

[58] Field of Search ..... 30/526, 527, 530, 30/532, 533, 50, 47

[56] References Cited

U.S. PATENT DOCUMENTS

| | | | |
|---|---|---|---|
| D. 343,026 | 1/1994 | Dallaire et al. . | |
| 2,741,028 | 4/1956 | Carter . | |
| 3,311,975 | 4/1967 | De Longuyon . | |
| 3,363,312 | 1/1968 | Fayed . | |
| 3,374,540 | 3/1968 | DeLonguyon . | |
| 3,878,605 | 4/1975 | Braginetz . | |
| 3,950,849 | 4/1976 | Perry | 30/47 |
| 4,037,322 | 7/1977 | Bresler . | |
| 4,163,316 | 8/1979 | Hagmann et al. | 30/47 |
| 4,227,302 | 10/1980 | Torrance | 30/47 |
| 4,253,237 | 3/1981 | Jacobson . | |
| 4,266,340 | 5/1981 | Bowman . | |
| 4,283,850 | 8/1981 | Douglass et al. | 30/47 |
| 4,288,919 | 9/1981 | Rait | 30/47 |
| 4,411,065 | 10/1983 | Trotta | 30/47 |
| 4,413,411 | 11/1983 | Trotta | 30/526 |
| 4,422,237 | 12/1983 | Trotta | 30/526 |
| 4,446,619 | 5/1984 | Jacobson | 30/520 |
| 4,514,904 | 5/1985 | Bond . | |

(List continued on next page.)

FOREIGN PATENT DOCUMENTS

| | | |
|---|---|---|
| 0 203 527 A1 | 5/1986 | European Pat. Off. . |
| 0 271 860 | 6/1988 | European Pat. Off. . |
| 2 639 280 A1 | 11/1988 | France . |
| 36 35 553 A1 | 4/1988 | Germany . |
| WO 93/20983 | 10/1993 | WIPO . |
| WO 94/08761 | 4/1994 | WIPO . |
| WO 95 10398 | 4/1995 | WIPO . |
| WO 97 37819 | 10/1997 | WIPO . |

OTHER PUBLICATIONS

Copy of International Search Report dated Jun.22, 1998, PCT/US98/02947.

PCT/US97/05697 International Search Report, Jan. 21, 1998.

PCT/US97/05697 International Search Report, Sep. 18, 1997.

*Primary Examiner*—Hwei-Siu Payer

*Attorney, Agent, or Firm*—Fish & Richardson P.C.

[57] ABSTRACT

A replaceable razor blade cartridge including a blade unit, and cartridge connecting structure for connecting the blade unit to handle connecting structure of a handle, the cartridge connecting structure having inwardly directed surfaces for mating with outwardly directed surfaces on the handle connecting structure, the blade unit being pivotally connected to the cartridge connecting structure, the cartridge connecting structure including a latching member that is movable to release the cartridge from the handle connecting structure prior to retraction of the cartridge connecting structure from the handle connecting structure.

46 Claims, 6 Drawing Sheets

U.S. PATENT DOCUMENTS 4,658,505 4/1987 Williams .
4,797,998 1/1989 Motta ..... 30/530
4,905,372 3/1990 Willis .
4,926,553 5/1990 Miskin et al. .
5,016,352 5/1991 Metcalf .
5,027,511 7/1991 Miller .
5,107,590 4/1992 Burout, III et al. .
5,207,754 5/1993 Harrah .
5,269,062 12/1993 Dallaire et al. .
5,347,717 9/1994 Ts'ai .
5,469,621 11/1995 Alsept et al. ..... 30/50
5,497,551 3/1996 Apprille, Jr. ..... 30/526
5,526,567 6/1996 Carson, III et al. ..... 30/50
5,787,586 8/1998 Apprille, Jr. et al. .

SHAVING SYSTEM INCLUDING HANDLE AND REPLACEABLE CARTRIDGES

This application is a continuation-in-part of an application Ser. No. 08/630,437 filed Apr. 10, 1996 now U.S. Pat. No. 5,787,586.

BACKGROUND OF THE INVENTION

The invention relates to shaving systems having handles and replaceable cartridges.

Shaving systems often consist of a handle and a replaceable cartridge in which one or more blades are mounted in a plastic housing. After the blades in a cartridge have become dull from use, the cartridge is discarded, and replaced on the handle with a new cartridge. In some shaving systems the blades are resiliently mounted with respect to the cartridge housing and deflect under the force of skin contact during shaving. In some shaving systems the connection of the cartridge to the handle provides a pivotal mounting of the cartridge with respect to the handle so that the cartridge angle adjusts to follow the contours of the surface being shaved. In such systems, the cartridge can be biased toward an at rest position by the action of a spring-biased plunger (a cam follower) carried on the handle against a cam surface on the cartridge housing.

SUMMARY OF THE INVENTION

In one aspect, the invention features, in general, a replaceable razor blade cartridge that includes a blade unit and cartridge connecting structure for connecting the blade unit to a handle. The cartridge connecting structure has inwardly directed surfaces that partially define a handle-receiving region and mate with outwardly directed surfaces on handle connecting structure of the handle. The cartridge connecting structure also has a connection entrance to the handle-receiving region and a projection that extends into the handle-receiving region. The projection has a blocking surface facing the opposite direction from the connection entrance to retain the handle connecting structure on the cartridge connecting structure.

In another aspect, the invention features, in general, a replaceable razor blade cartridge that includes a blade unit that is pivotally connected to a cartridge connecting structure that includes a latching member that is movable to release the cartridge from a handle.

In another aspect, the invention features, in general, a replaceable razor blade cartridge that includes a blade unit and a cartridge connecting structure for connecting and disconnecting the blade unit to a handle by movement along a connection axis. The cartridge connecting structure includes a latching member that is movable to release the cartridge from the handle prior to retraction of the cartridge connecting structure from the handle along the connection axis.

Certain implementations of the invention include one or more of the following features. In certain implementations the latching member includes a projection with a blocking surface that blocks retraction of the handle connecting structure from the cartridge connecting structure when in a latched position and permits retraction of the handle connecting structure from the cartridge connecting structure when in an unlatched position. The latching member includes engagement structure that is movable from an initial position to a deflected position, the blocking surface moving from the latched position to the unlatched position as the engagement structure is moved from the initial position to the deflected position. The projection is movable generally along a deflection axis that is transverse to the connection axis, and the projection has a camming surface on the opposite side of the deflection axis from the blocking surface, the camming surface making a larger angle with the deflection axis than the blocking surface. The latching member includes a cantilevered beam structure with a base region and an unsupported end; the projection is closer to the base region than the engagement structure, and the engagement structure is closer to the free end than the blocking surface.

The handle connecting structure of the handle has an ejector that is extendible from the handle, and the engagement structure is aligned with the ejector. The engagement structure is on the unsupported end of the cantilever structure, and the unsupported end is bent such that the projection is deflected in a transverse direction from the ejector movement when the engagement structure is engaged by the ejector. The angle of the blocking surface with the deflection axis is between 0° and 10°: and the angle of the camming surface with the deflection axis is between 30° and 60°. There are two projections, and two bent ends engaged by the ejector. There are two slots separating the cantilevered beam structure from adjacent portions of the cartridge connecting structure. There are two grooves extending from the two slots at the base region. Sections in planes transverse to the connection axis through the inwardly directed surfaces and the mating outwardly directed surfaces have asymmetrical shapes to promote proper alignment during connection.

In another aspect, the invention features, in general, shaving razors including cartridges as have already been described and handles connected to the cartridges.

In another aspect, the invention features, in general, methods of connecting replaceable shaving cartridges as have already been described to handles and disconnecting the cartridges from the handles by moving latching members to release the cartridges from the handles.

Embodiments of the invention may include one or more of the following advantages. The use of a latching member permits the cartridge to be securely attached to the handle with little likelihood of unintended detachment during use. In addition the cartridge can be released and removed from the handle with little force when it is desired to replace the cartridge.

Other features and advantages of the invention will be apparent from the following description of embodiments thereof and from the claims.

DESCRIPTION OF THE PREFERRED EMBODIMENT

Figure 1:
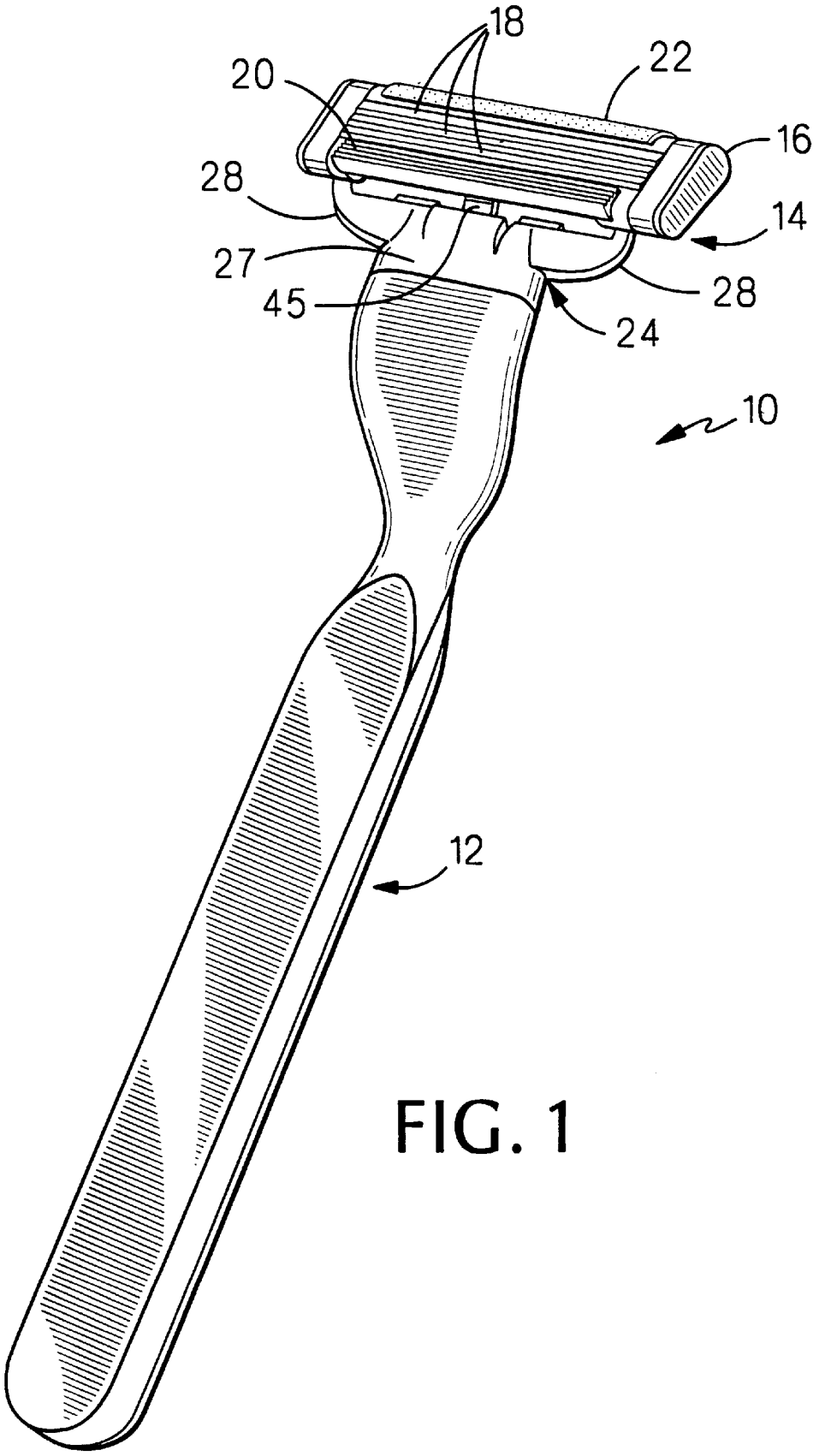
FIG. 1 is a perspective view of a shaving razor according to the invention.
Figure 2:
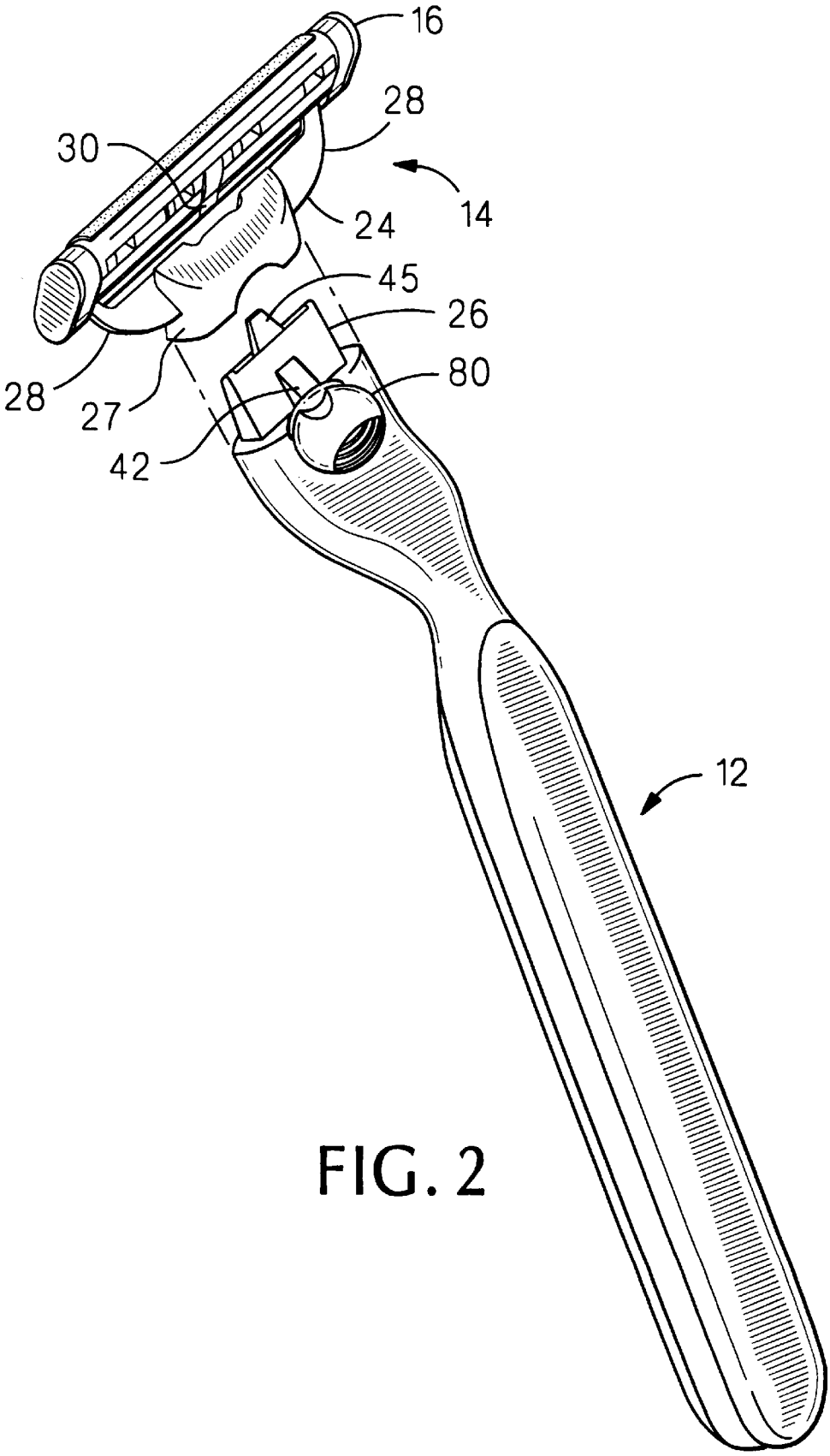
FIG. 2 is a perspective view showing a handle and a replaceable cartridge of the FIG. 1 razor separated from each other.

Referring to FIGS. 1 and 2, shaving razor 10 includes handle 12 and replaceable shaving cartridge 14. As shown in FIG. 2, cartridge 14 is removable from handle 12. Cartridge 14 includes blade unit 16, which carries three spring-biased blades 18, guard 20 and cap 22. Cartridge 14 also includes interconnect member 24 on which blade unit 16 is pivotally mounted. Interconnect member 24 includes base 27, which removably and fixedly attaches to asymmetrical extension 26 on handle 12, and two arms 28 that pivotally support blade unit 16 at its two sides. Base 27 acts as a cartridge connecting structure, and extension 26 acts as a handle connecting structure. These two structures connect to each other to connect a replaceable cartridge 14 to handle 12. Spring biased plunger 45 extends from extension 26, passes through an opening at the top of base 27 and acts against cam surface 30 on blade unit 16, causing it to have a forward-biased at-rest orientation, as is discussed in detail in the above-referenced application, which is hereby incorporated by reference.

Figure 3:
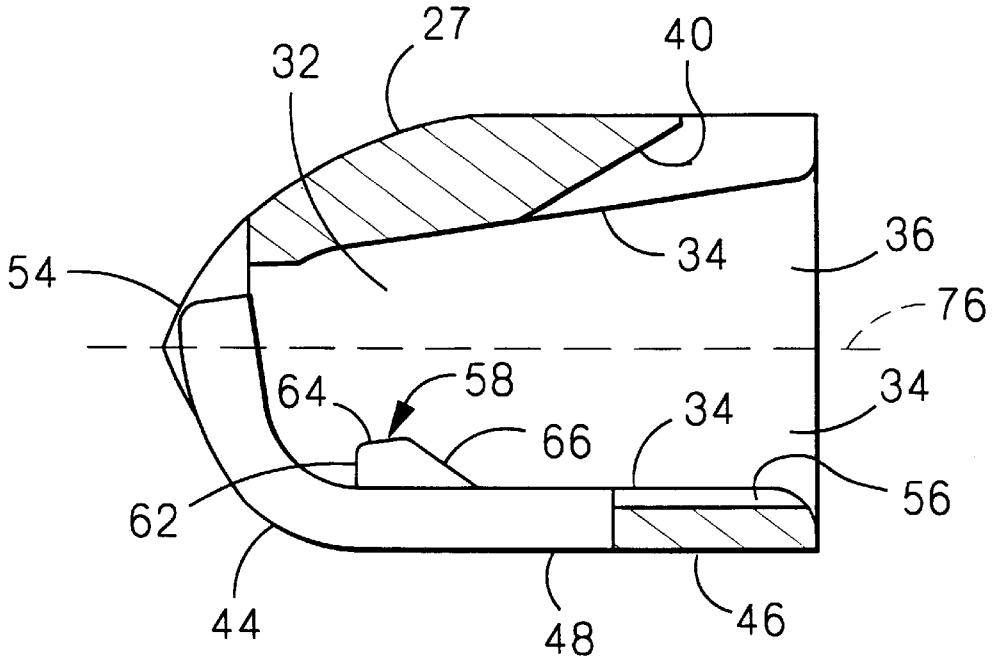
FIG. 3 is a partial sectional view, taken at 3—3 of FIG. 6, of a cartridge connecting structure of the FIG. 2 replaceable cartridge.
Figure 4:
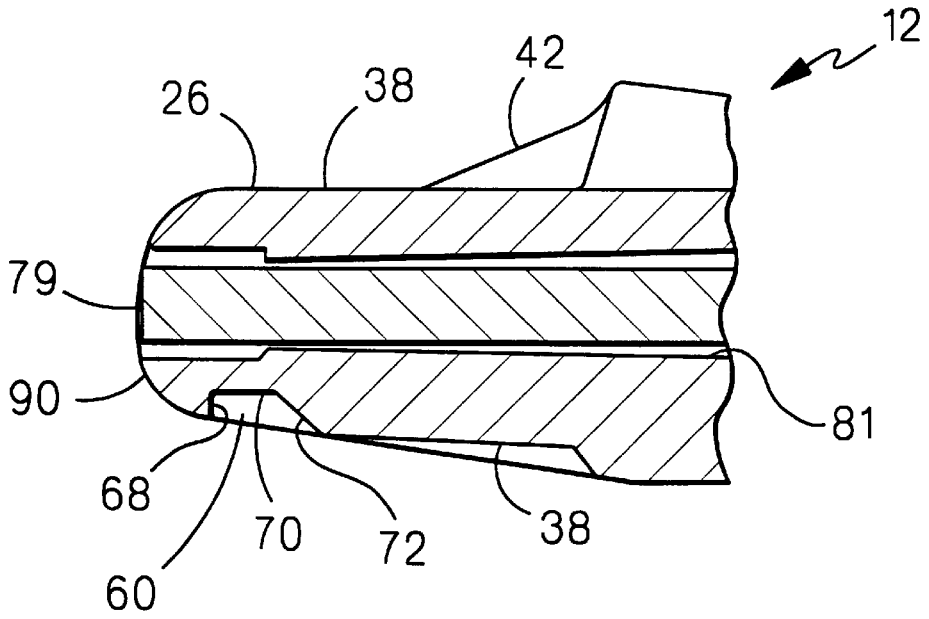
FIG. 4 is a partial sectional view of a handle connecting structure of the FIG. 2 handle.

Referring to FIGS. 3 and 4, base 27 has handle-receiving region 32 that is partially defined by inwardly directed surfaces 34. Connection entrance 36 provides access to handle-receiving region 32. Inwardly directed surfaces 34 mate with outwardly directed surfaces 38 on extension 26 of handle 12. Base 27 also has an angled recess region 40 for receiving angled surface 42 on handle 12.

Figure 5:
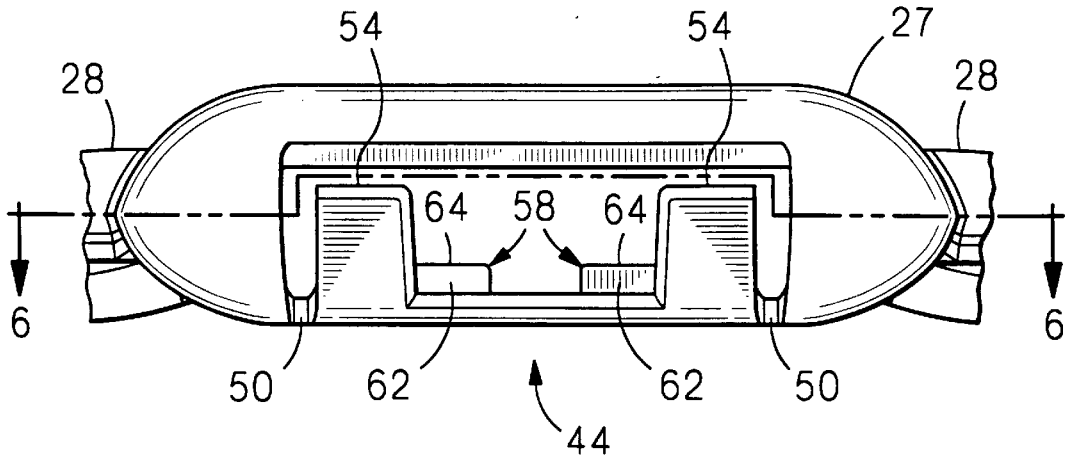
FIG. 5 is a partial elevation of the FIG. 3 cartridge connecting structure.
Figure 6:
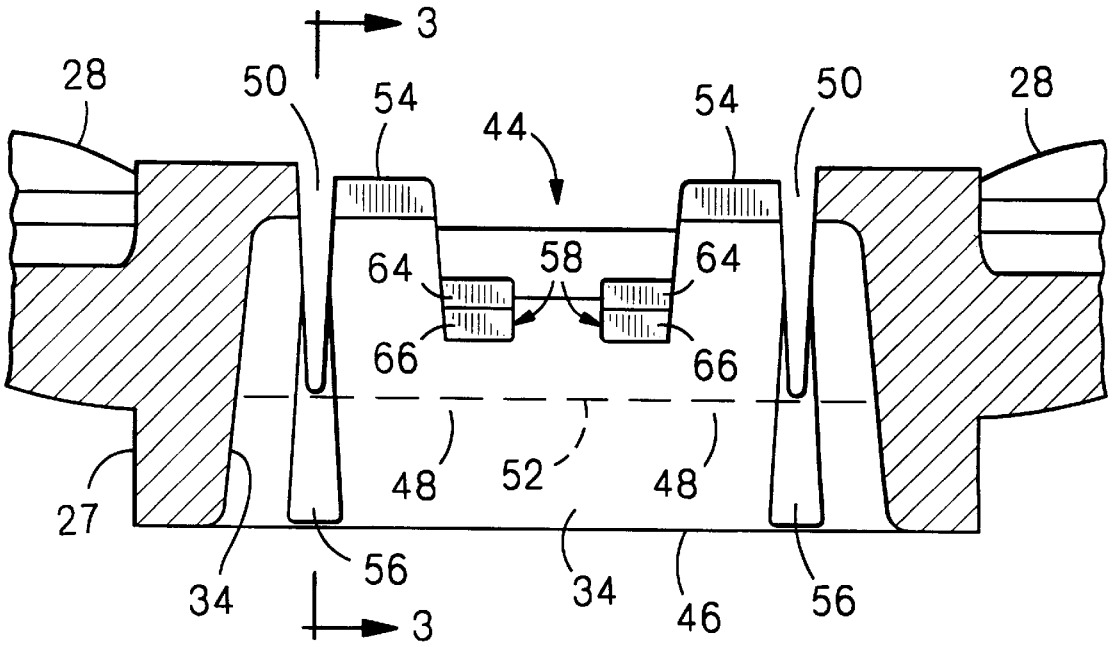
FIG. 6 is a partial sectional view, taken at 6—6 of FIG. 5, of the FIG. 3 cartridge connecting structure.

Referring to FIGS. 3, 5 and 6, base 27 has latching member 44 formed in the bottom wall 46 thereof. As shown in FIGS. 3 and 6, latching member 44 has a cantilevered beam structure, and is connected to bottom wall 46 at base region 48 near the ends of slots 50. Latching member 44 tends to pivot about axis 52 (FIG. 6) upon being subjected to a force with an outward component at the free end at engagement members 54 (i.e., to the left along connection axis 76 in FIG. 3). Bottom wall 46 also has grooves 56 (FIGS. 3, 6) extending backward from slots 50 to promote pivoting of latching member 44.

Two projections 58 (FIGS. 3, 5, 6) extend upward from latching member 44 for interacting with depressions 60 formed in the lower surface of extension 26 of handle 12 (FIG. 4). Each projection 58 has a front blocking surface 62, a top surface 64, and an angled camming surface 66, which makes about a 45° angle with connection axis 76 along which extension 26 moves during connection to and retraction from base 27. Other angles, e.g., between 30° and 60° could also be used. Depressions 60 similarly have front surfaces 68 for interacting with front blocking surface 62, top surface 70 and rear angled surface 72 for receiving top surface 64 and camming surface 66, respectively, of projections 58. Front blocking surface 62 of projection 58 makes about a 90° angle with connection axis 76.

Figure 9:
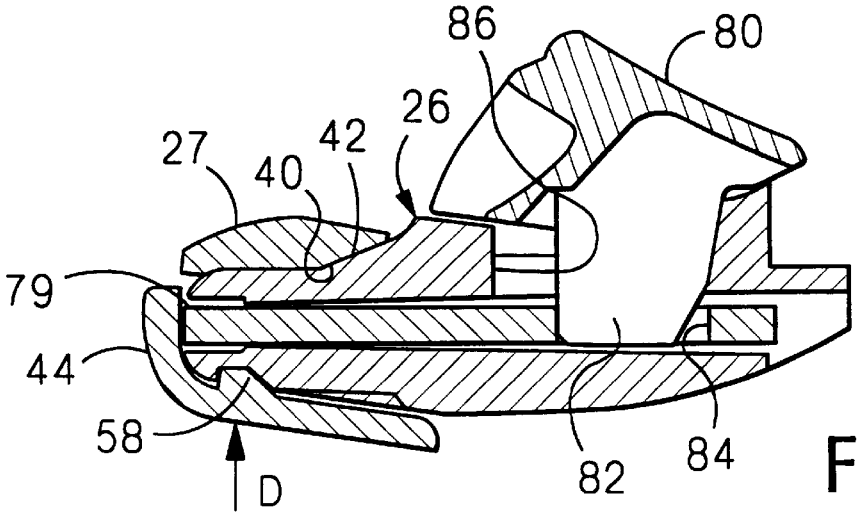
Figure 10:
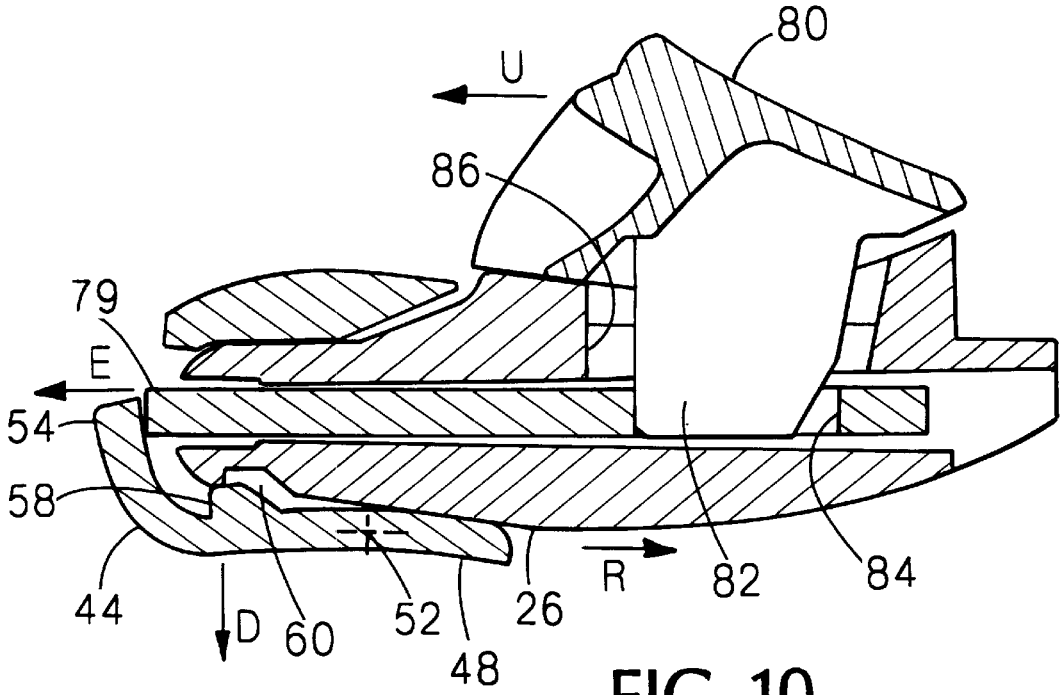
Figure 11:
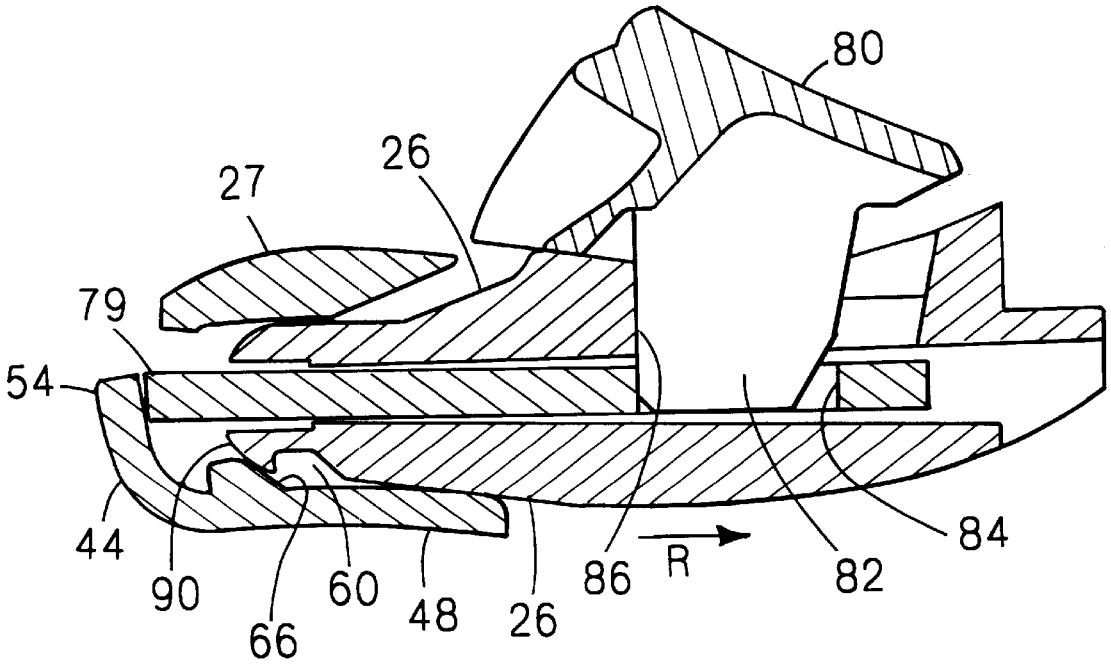

Referring to FIG. 4, ejector 79 is slidably mounted within recess 81 within the handle connecting structure of handle 12. It is shown at an at-rest position in FIG. 4, and can be moved forward slightly by activating button 80 on handle 12. (See FIGS. 2 and 9–11.) Referring to FIGS. 9–11, button 80 has a lower extension 82 that sits within opening 84 of ejector 79. Moving button 80 forward relative to extension 26 on which is it mounted (i.e., to the left in FIG. 9) causes ejector 79 to be moved forward from the position of FIG. 9 to the position of FIGS. 10 and 11. FIG. 11 shows the front of extension 82 against stop surface 86 of extension 26.

FIGS. 7–11 are sectional views showing the components of handle 12 and cartridge 14 that interact during connection and disconnection of cartridge 14 to handle 12. The components of the handle connecting structure shown in these figures are part of a subassembly that includes extension 26; the rest of the subassembly is received within handle 12 and thus is not seen in FIG. 2.

Figure 7:
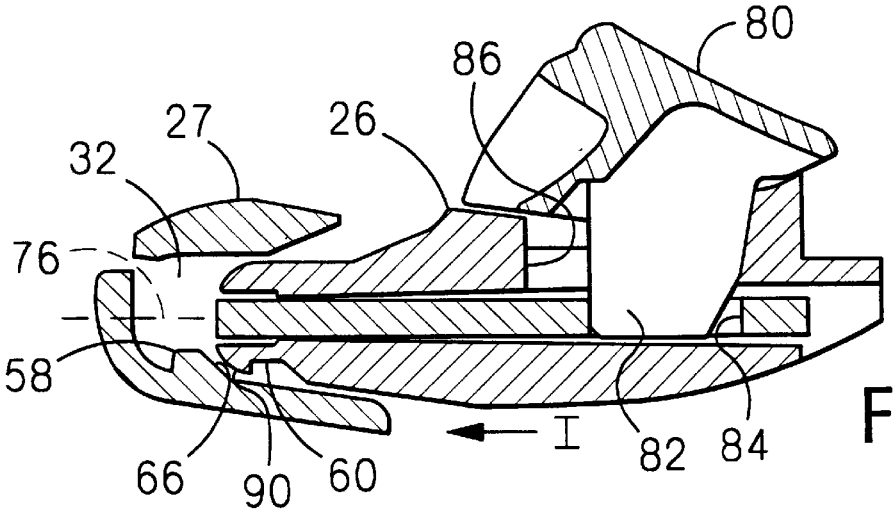
FIGS. 7–11 are diagrammatic partial sectional views of portions of the FIG. 3 cartridge connecting structure and portions of the FIG. 4 handle connecting structure at different times during connection and disconnection.

Referring to FIG. 7, extension 26 of handle 12 is shown being advanced along connection axis 76 in the insertion direction I indicated by the arrow. It is seen that extension 26 fits within handle-receiving region 32 of base 27. As shown in FIG. 7, button 80 is in an at-rest position, and lower sloping front surface 90 of extension 26 is about to contact camming surface 66 of projection 58.

Figure 8:
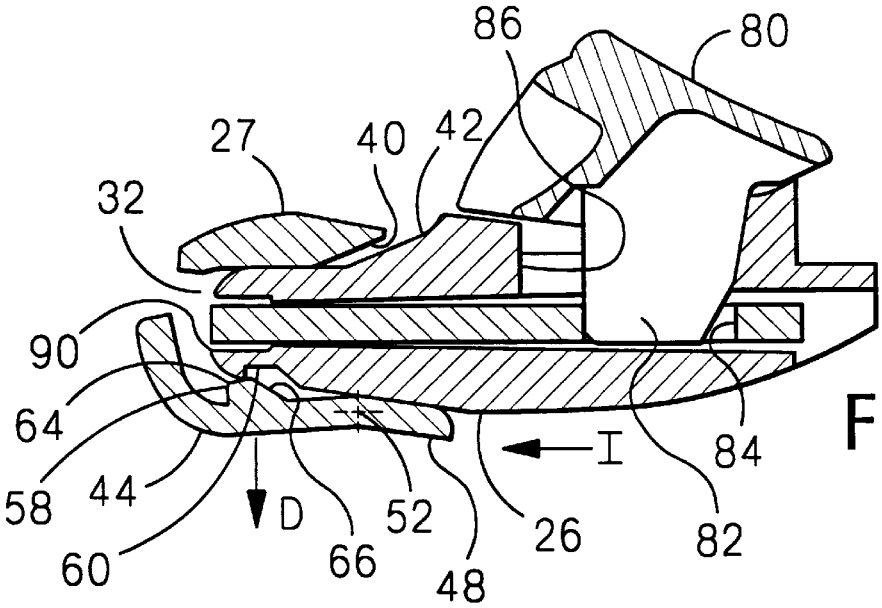

Referring to FIG. 8, as extension 26 of handle 12 is moved further in the insertion direction indicated by arrow I, sloping surface 90 of extension 26 rides over camming surface 66, causing latch member 44 and in particular projection 58 thereon to move downward along the deflection axis indicated by arrow D, which is substantially perpendicular to connection axis 76 and the direction of insertion I. The action of sloping surface 90 on camming surface 66 causes latching member 44 to bend generally about axis 52 in the base region. (See FIGS. 6 and 8.) In the position shown in FIG. 8, the lowest portion of sloping surface 90 is shown riding on top of top surface 64 of projection 58. Owing to sloping surface 90 and camming surface 66, relatively minor connection forces are needed to deflect latching member 44 and to connect cartridge 14 to handle 12.

Referring to FIG. 9, extension 26 of handle 12 is shown in the position in which it is connected to base 27 of cartridge 14. Sloping surface 90 has advanced past projection 58, and latching member 44 has moved up to the latched position in which projection 58 has snapped up into depression 60 of extension 26. In this position cartridge 14 is securely attached to handle 12 with little likelihood of unintended detachment during use owing to interference of surface 68 on handle 12 and blocking surface 62 on cartridge 14. Surfaces 62 and 68 are substantially perpendicular to axis 76 along which extension 26 needs to be moved relative to base 27 to disconnect the two. Thus very large forces along axis 76 would need to be exerted to disconnect cartridge 14 from handle 12 if one does not first unlatch latching member 44.

Referring to FIG. 10, when the user wishes to disconnect cartridge 14 from handle 12, button 80 is moved relative to extension 26 in the unlatched direction indicated by arrow U on FIG. 10, and this causes ejector 79 to be moved along axis 76 in the ejection direction indicated by arrow E. Ejector 79 pushes engagement members 54 outward, causing projection 58 to move downward in the deflection direction indicated by arrow D as latching member 44 bends at axis 52 at base region 48. This downward movement causes projection 58 to clear depression 60 and to release extension 26 from latching member 44 so that extension 26 moves relative to base 27 in the retraction direction indicated by arrow R. As shown in FIG. 10, extension 82 of button 80 has moved forward from the position shown in FIG. 9.

In FIG. 11, button 80 has moved further forward, and extension 82 is against stop surface 86. Extension 26 has moved further in the retraction direction R such that the front sloping surface 90 is riding down camming surface 66. As extension 26 continues to be retracted from base 27, ejector 79 will eventual move backward from engagement members 54, permitting latching member 44 to move back to the at rest disconnected position shown in FIG. 7.

Other embodiments of the invention are within the scope of the appended claims. For example, blocking surface 62 and/or facing surface 68 of extension 26 could be at slightly less than 90° (e.g., between 80° and 90°) with respect to connection axis 76 to permit base 27 to disconnect from an extension 26 upon being subjected to a force that is substantially larger than forces to which the parts would be subjected during normal shaving. This force could also be larger than the forces needed to connect a cartridge 14 to handle 12. When the blocking surface on the projection extending in from the base 27 is so angled, one can avoid use of a latching member that needs to be deflected prior to retraction, as described in the above-referenced patent application; in this case base 27 will deform during retraction to permit the projection to clear the depression in the handle extension.

What is claimed is:

1. A shaving razor comprising a handle having handle connecting structure with outwardly directed surfaces and a depression in one of said outwardly directed surfaces, and a replaceable cartridge comprising a blade unit, and cartridge connecting structure connecting said blade unit to said handle connecting structure, said cartridge connecting structure having inwardly directed surfaces mating with said outwardly directed surfaces, said cartridge connecting structure having a handle-receiving region partially defined by said inwardly directed surfaces and a connection entrance open to said handle-receiving region, said handle-receiving region having a remote portion that is at an opposite end of said region from said entrance, said cartridge connecting structure including a projection that extends into said handle-receiving region and into said depression and has a blocking surface facing the opposite direction from said connection entrance to retain said handle connecting structure on said cartridge connecting structure, said projection being located closer to said remote portion than said entrance.

2. A shaving razor comprising a handle having handle connecting structure, and a replaceable cartridge comprising a blade unit, and cartridge connecting structure connecting said blade unit to said handle connecting structure by movement along a connection axis, said blade unit being pivotally connected to said cartridge connecting structure, said cartridge connecting structure including a body and a latching member that is displaceable relative to said body away from said connection axis to release said cartridge from said handle connecting structure, displacement of said latching member permitting subsequent movement of said cartridge connecting structure away from said handle connecting structure along said connection axis.

3. A shaving razor comprising a handle having handle connecting structure, and a replaceable cartridge comprising a blade unit, and cartridge connecting structure for connecting and disconnecting said blade unit to said handle connecting structure by movement along a connection axis, said cartridge connecting structure including a latching member that is movable to release said cartridge from said handle connecting structure prior to retraction of said cartridge connecting structure from said handle connecting structure along said connection axis, said latching member including a cantilevered beam structure with a base region and an unsupported end.

4. The razor of claim 3 wherein said latching member includes a blocking surface that blocks retraction of said handle connecting structure from said cartridge connecting structure when in a latched position and permits retraction of said handle connecting structure from said cartridge connecting structure when in an unlatched position.

5. The razor of claim 4 wherein said latching member includes engagement structure that is movable from an initial position to a deflected position, said blocking surface moving from said latched position to said unlatched position as said engagement structure is moved from said initial position to said deflected position.

6. The razor of claim 5 wherein said handle connecting structure has an ejector and said engagement structure has two portions that are engaged by said ejector.

7. The razor of claim 5 or 6 wherein said latching member includes a second blocking surface that blocks retraction of said handle connecting structure from said cartridge connecting structure when in a latched position and permits retraction of said handle connecting structure from said cartridge connecting structure when in an unlatched position.

8. The razor of claim 5 wherein said blocking surface is on a projection on said latching member.

9. The razor of claim 8 wherein said projection is movable generally along a deflection axis that is transverse to said connection axis, said projection having a camming surface on the opposite side of said deflection axis from said blocking surface, said camming surface making a larger angle with said deflection axis than said blocking surface.

10. The razor of claim 5 wherein said blocking surface is closer to said base region than said engagement structure, and said engagement structure is closer to said unsupported end than said blocking surface.

11. A shaving razor comprising a handle having handle connecting structure, and a replaceable cartridge comprising a blade unit, and cartridge connecting structure for connecting and disconnecting said blade unit to said handle connecting structure by movement along a connection axis, said cartridge connecting structure including a latching member that is movable to release said cartridge from said handle connecting structure prior to retraction of said cartridge connecting structure from said handle connecting structure along said connection axis, wherein said latching member includes a blocking surface that blocks retraction of said handle connecting structure from said cartridge connecting structure when in a latched position and permits retraction of said handle connecting structure from said cartridge connecting structure when in an unlatched position, wherein said latching member includes engagement structure that is movable from an initial position to a deflected position, said blocking surface moving from said latched position to said unlatched position as said engagement structure is moved from said initial position to said deflected position, wherein said handle connecting structure has an ejector that is extendible therefrom, and said engagement structure is aligned with said ejector when said handle is connected to said cartridge.

12. A replaceable razor blade cartridge comprising a blade unit, and cartridge connecting structure for connecting said blade unit to handle connecting structure of a handle, said cartridge connecting structure having inwardly directed surfaces for mating with outwardly directed surfaces on said handle connecting structure, said cartridge connecting structure having a handle-receiving region partially defined by said inwardly directed surfaces and a connection entrance open to said handle-receiving region, said handle-receiving region having a remote portion that is at an opposite end of said region from said entrance, said cartridge connecting structure including a projection that extends into said handle-receiving region and has a blocking surface facing the opposite direction from said connection entrance to retain said handle connecting structure on said cartridge connecting structure, said projection being located closer to said remote portion than said entrance.

13. The cartridge of claim 12 wherein said blade unit is pivotally connected to said cartridge connecting structure.

14. The cartridge of claim 12 wherein said cartridge connecting structure includes a latching member that is movable to release said cartridge connecting structure from said handle connecting structure, and said projection is carried on said latching member.

15. A replaceable razor blade cartridge comprising a blade unit, and cartridge connecting structure for connecting said blade unit to handle connecting structure of a handle, said cartridge connecting structure having inwardly directed surfaces for mating with outwardly directed surfaces on said handle connecting structure, said cartridge connecting structure having a handle-receiving region partially defined by said inwardly directed surfaces and a connection entrance open to said handle-receiving region, said cartridge connecting structure including a projection that extends into said handle-receiving region and has a blocking surface facing the opposite direction from said connection entrance to retain said handle connecting structure on said cartridge connecting structure, wherein said cartridge connecting structure has a connection axis passing through said connection axis and into said handle receiving region, and wherein a section through said inwardly directed surfaces in a plane transverse to said connection axis is asymmetrical.

16. A replaceable razor blade cartridge comprising a blade unit, and cartridge connecting structure for connecting said blade unit to handle connecting structure of a handle by movement along a connection axis, said blade unit being pivotally connected to said cartridge connecting structure, said cartridge connecting structure including a body and a latching member that is displaceable relative to said body away from said connection axis to release said cartridge from said handle connecting structure, displacement of said latching member permitting subsequent movement of said cartridge connecting structure away from said handle connecting structure along said connection axis.

17. A replaceable razor blade cartridge comprising a blade unit, and cartridge connecting structure for connecting and disconnecting said blade unit to handle connecting structure of a handle by movement along a connection axis, said cartridge connecting structure including a latching member that is movable to release said cartridge from said handle connecting structure prior to retraction of said cartridge connecting structure from said handle connecting structure along said connection axis, said latching member including a cantilevered beam structure with a base region and an unsupported end.

18. The cartridge of claim 17 wherein said cartridge connecting structure has a handle receiving region and a cartridge connection entrance open to said handle receiving region, said latching member further comprising a camming surface inclined away from said connection entrance which is adapted to be contacted by an axial force directed parallel to said connection axis, wherein said connection axis is perpendicular to said connection entrance in order to deflect said latching member away from said axis.

19. The cartridge of claim 17 wherein said cartridge connecting structure has a handle receiving region and a cartridge connection entrance open to said handle receiving region, wherein said cantilevered beam extends parallel to said connection axis, the connection axis being formed perpendicular to the connection entrance.

20. The cartridge of claim 3 wherein said latching member includes a blocking surface that blocks retraction of said handle connecting structure from said cartridge connecting structure when in a latched position and permits retraction of said handle connecting structure from said cartridge connecting structure when in an unlatched position.

21. The cartridge of claim 20 wherein said latching member includes engagement structure that is movable from an initial position to a deflected position, said blocking surface moving from said latched position to said unlatched position as said engagement structure is moved from said initial position to said deflected position.

22. A replaceable razor blade cartridge comprising a blade unit, and cartridge connecting structure for connecting and disconnecting said blade unit to handle connecting structure of a handle by movement along a connection axis, said cartridge connecting structure including a latching member that is movable to release said cartridge from said handle connecting structure prior to retraction of said cartridge connecting structure from said handle connecting structure along said connection axis, wherein said latching member includes a blocking surface that blocks retraction of said handle connecting structure from said cartridge connecting structure when in a latched position and permits retraction of said handle connecting structure from said cartridge connecting structure when in an unlatched position, wherein said latching member includes engagement structure that is movable from an initial position to a deflected position, said blocking surface moving from said latched position to said unlatched position as said engagement structure is moved from said initial position to said deflected position, wherein said handle connecting structure has an ejector that is extendible therefrom, and said engagement structure is aligned with said ejector when said handle is connected to said cartridge.

23. The cartridge of claim 21 wherein said engagement structure has two portions that are adapted to be engaged by an ejector on said handle.

24. The cartridge of claim 21 or 23 wherein said latching member includes a second blocking surface that blocks retraction of said handle connecting structure from said cartridge connecting structure when in a latched position and permits retraction of said handle connecting structure from said cartridge connecting structure when in an unlatched position.

25. The cartridge of claim 21 wherein said blocking surface is closer to said base region than said engagement structure, and said engagement structure is closer to said unsupported end than said blocking surface.

26. The cartridge of claim 25 wherein said handle connecting structure has an ejector that is extendible therefrom, and said engagement structure is aligned with said ejector when said handle is connected to said cartridge.

27. The cartridge of claim 26 wherein said engagement structure is on said unsupported end, and wherein said unsupported end is bent such that said blocking surface is deflected in a transverse direction from ejector movement when said engagement structure is engaged by said ejector.

28. The cartridge of claim 21 wherein said blocking surface is on a projection on said latching member.

29. The cartridge of claim 28 wherein said projection is movable generally along a deflection axis that is transverse to said connection axis, said projection having a camming surface on the opposite side of said deflection axis from said blocking surface, said camming surface making a larger angle with said deflection axis than said blocking surface.

30. The cartridge of claim 29 wherein said angle of said blocking surface with said deflection axis is between 0° and 10°.

31. The cartridge of claim 20 wherein said cartridge connecting structure has inwardly directed surfaces for mating with outwardly directed surfaces on said handle connecting structure, wherein said cartridge connecting structure has a handle-receiving region partially defined by said inwardly directed surfaces and a connection entrance open to said handle-receiving region, said connection axis passing through said connection entrance, wherein said latching member includes a projection that extends into said handle-receiving region, said blocking surface being located on said projection and facing the opposite direction from said connection entrance to retain said handle connecting structure on said cartridge connecting structure.

32. The cartridge of claim 31 wherein said latching member includes engagement structure that is movable from an initial position to a deflected position, said blocking surface moving from said latched position to said unlatched position as said engagement structure is moved from said initial position to said deflected position.

33. The cartridge of claim 32 wherein said projection is movable generally along a deflection axis that is transverse to said connection axis, said projection having a camming surface on the opposite side of said deflection axis from said blocking surface, said camming surface making a larger angle with said deflection axis than said blocking surface.

34. The cartridge of claim 33 wherein said angle of said blocking surface with said deflection axis is between 0° and 10°.

35. The cartridge of claim 30 or 34 wherein said angle of said camming surface with said deflection axis is between 30° and 60°.

36. The cartridge of claim 32 wherein said projection is closer to said base region than said engagement structure, and said engagement structure is closer to said unsupported end than said blocking surface.

37. The cartridge of claim 36 wherein said handle connecting structure has an ejector that is extendible therefrom, and said engagement structure is aligned with said ejector when said handle is connected to said cartridge.

38. The cartridge of claim 37 wherein said ejector moves along said connection axis, and said engagement structure is on said unsupported end, and wherein said unsupported end is bent, whereby said projection is deflected in a transverse direction when engaged by said ejector.

39. The cartridge of claim 38 wherein there are two said projections.

40. The cartridge of claim 39 wherein there are two said bent ends engaged by said ejector.

41. The cartridge of claim 36 wherein there are two slots separating said cantilevered beam structure from adjacent portions of said cartridge connecting structure.

42. The cartridge of claim 41 wherein there are two grooves extending from said two slots at said base region.

43. The cartridge of claim 17 wherein said cartridge connecting structure has a handle-receiving region and a connection entrance open to said region, and said base region is located closer to said entrance than is said unsupported end.

44. A method of connecting a cartridge to a handle comprising providing a replaceable razor blade cartridge comprising a blade unit, and cartridge connecting structure for connecting said blade unit to handle connecting structure of a handle, said cartridge connecting structure having inwardly directed surfaces for mating with outwardly directed surfaces on said handle connecting structure, said cartridge connecting structure having a handle-receiving region partially defined by said inwardly directed surfaces and a connection entrance open to said handle-receiving region, said handle-receiving region having a remote portion that is at an opposite end of said region from said entrance, said cartridge connecting structure including a projection that extends into said handle-receiving region and has a blocking surface facing the opposite direction from said connection entrance to retain said handle connecting structure on said cartridge connecting structure, said projection being located closer to said remote portion than said entrance, connecting a handle to said cartridge by moving said handle into said handle-receiving region past said projection and said blocking structure and mating said inwardly directed surfaces with said outwardly directed surfaces, and retaining said cartridge on said handle by said blocking surface acting on said handle at a location remote from the entrance.

45. A method of disconnecting a cartridge from a handle comprising providing a replaceable razor blade cartridge comprising a blade unit, and cartridge connecting structure for connecting said blade unit to handle connecting structure of a handle by movement along a connection axis, said blade unit being pivotally connected to said cartridge connecting structure, said cartridge connecting structure including a body and a latching member that is movable away from said connection axis to release said cartridge from said handle connecting structure, and a handle connected to said cartridge, displacing said latching member relative to said body away from said connection axis to release said cartridge from said handle, and thereafter removing said cartridge from said handle by moving said cartridge connecting structure away from said handle connecting structure along said connection axis.

46. A method of disconnecting a cartridge from a handle comprising providing a replaceable razor blade cartridge comprising a blade unit, and cartridge connecting structure for connecting and disconnecting said blade unit to handle connecting structure of a handle by movement along a connection axis, said cartridge connecting structure including a latching member that is movable to release said cartridge from said handle connecting structure prior to retraction of said cartridge connecting structure from said handle connecting structure along said connection axis, said latching member including a cantilevered beam structure with a base region and an unsupported end, and a handle connected to said cartridge, displacing said unsupported end of said latching member away from said connection axis to release said cartridge from said handle, and thereafter removing said cartridge from said handle by retracting said cartridge connecting structure from said handle connecting structure along said connection axis.

* * * * *

UNITED STATES PATENT AND TRADEMARK OFFICE

CERTIFICATE OF CORRECTION

PATENT NO.: 5,956,851

DATED: SEPTEMBER 28, 1999

INVENTORS: APPRILLE, JR. ET AL.

It is certified that error appears in the above-identified patent and that said Letters Patent is hereby corrected as shown below:

Column 7, line 48, delete "axis" (2nd occurrence)and replace with --entrance--.

Column 10, line 53, delete "structure" and replace with –surface--.

Signed and Sealed this

Tenth Day of October, 2000

*Attest:*

Q. TODD DICKINSON

*Attesting Officer*

*Director of Patents and Trademarks*